US007240421B2

(12) United States Patent
Miyoshi et al.

(10) Patent No.: US 7,240,421 B2
(45) Date of Patent: Jul. 10, 2007

(54) ELECTRIC-WIRE PROCESSING MACHINE

(75) Inventors: Akira Miyoshi, Hyogo (JP); Tetsuya Yano, Hyogo (JP)

(73) Assignee: ShinMaywa Industries, Ltd., Takarazuka-shi (JP)

( * ) Notice: Subject to any disclaimer, the term of this patent is extended or adjusted under 35 U.S.C. 154(b) by 325 days.

(21) Appl. No.: 10/943,989

(22) Filed: Sep. 20, 2004

(65) Prior Publication Data

US 2005/0097731 A1 May 12, 2005

(30) Foreign Application Priority Data

Sep. 19, 2003 (JP) ..... 2003-328297

(51) Int. Cl.
*H01R 43/048* (2006.01)
*H01R 43/052* (2006.01)

(52) U.S. Cl. ..... 29/759; 29/748; 29/753; 29/861

(58) Field of Classification Search ..... 29/861–964, 29/753, 759, 760, 761, 33 M; 242/615.2, 242/615.3; 226/179, 180, 182
See application file for complete search history.

(56) References Cited

U.S. PATENT DOCUMENTS 3,401,859 A * 9/1968 Rienks et al. ..... 242/615.3
4,277,011 A * 7/1981 Jeter ..... 242/615.2
4,437,601 A * 3/1984 Brooks ..... 242/615.2
5,820,008 A * 10/1998 College ..... 226/34
6,209,378 B1 * 4/2001 Bradshaw ..... 72/250

FOREIGN PATENT DOCUMENTS

JP 2000-123947 4/2000

* cited by examiner

*Primary Examiner*—A. Dexter Tugbang
*Assistant Examiner*—Livius R. Cazan
(74) *Attorney, Agent, or Firm*—Oblon, Spivak, McClelland, Maier & Neustadt, P.C.

(57) ABSTRACT

An electric-wire guide unit is provided with a fixed roller and a movable roller that is supported movably toward and away from the fixed roller, and holds an electric wire from both of the sides of the electric wire in cooperation with the fixed roller. An electric-wire nozzle unit is provided with a fixed nozzle guide and a movable nozzle guide that is slidably placed, and forms a nozzle opening through which the electric wire is inserted, in cooperation with the fixed nozzle guide. A link mechanism, which couples the movable roller and the movable nozzle guide so as to be interlocked, is prepared. An tension spring, which presses the movable roller in an approaching direction toward the fixed roller, is attached. In accordance with the size of the diameter of the electric wire to be held between the movable roller and the fixed roller, the movable nozzle guide is slide-operated through the link mechanism so that the nozzle opening is size-adjusted. The present invention provides an electric-wire processing machine which can eliminate exchanging operations of electric-wire nozzle units depending on diameters of an electric wire, and shortens the operation time required for step-exchanging.

6 Claims, 9 Drawing Sheets

ELECTRIC-WIRE PROCESSING MACHINE

BACKGROUND OF THE INVENTION

1. Field of the Invention

The present invention relates to an electric-wire processing machine such as a double end terminal crimping device provided with an electric-wire nozzle unit to which an electric wire is guided and inserted, and more particularly concerns an electric-wire processing machine which eliminates the necessity of exchanging the electric-wire nozzle unit depending on diameters of electric wires to be processed.

2. Description of the Background Art

With respect to the double end terminal crimping device, conventionally, for example, those having a structure which has an electric-wire guide unit that guides an electric wire supplied along a predetermined electric-wire supplying direction, a clamping device that is placed on the downstream side of the electric-wire guide unit in the electric-wire supplying direction and has an air cylinder or the like that releasably clamps an electric wire, and a nozzle which is placed on the downstream side of the clamping device in the electric-wire supplying direction and through which an electric wire is guided and inserted (for example, see Japanese Patent Application Laid-Open No. 2000-123947).

Further, an electric wire that is fed by a predetermined length along the electric-wire supplying direction by a length-measuring unit is clamped by the clamping device, and in this state, the electric wire protruding from the nozzle is cut by a cutter unit and the coated portion of the electric wire end is subjected to a coat-removing process.

Then, the electric wire, clamped by the clamping device, is shifted to a terminal crimping unit position, and a terminal is crimped onto the coat-removed portion by the terminal crimping unit. After the terminal crimping process, the electric wire, clamped by the clamping device, is returned to an initial position that faces the cutter unit.

Thereafter, the electric wire that has been fed out is received by an electric-wire transporting unit, and in the same manner as described above, a terminal is crimped onto the other end of the electric wire by another terminal crimping unit.

Here, when the electric wire to be processed is changed to another electric wire having a different electric-wire diameter, the nozzle is exchanged to another nozzle having a nozzle opening that is suitable for the corresponding electric-wire diameter, in order to suppress pulsating movements of the electric wire that occur upon feeding the electric wire so as to stabilize the electric-wire supplying direction.

In the double end terminal crimping device having the conventional structure, however, upon step-exchanging process, it is necessary to exchange nozzles to a proper nozzle corresponding to the electric-wire diameter each time the electric-wire diameter is changed, and the resulting problem is that the step-exchanging process takes long time.

Moreover, it is also necessary to prepare and maintain nozzles of various sizes corresponding to electric-wire diameters for use in part-exchanging.

SUMMARY OF THE INVENTION

An object of the present invention is to provide an electric-wire processing machine which can eliminate the necessity of exchanging electric-wire nozzle units depending on electric-wire diameters, and shortens the operation time required for step-exchanging.

In accordance with one aspect of the present invention, an electric-wire processing machine, which has a clamping device that releasably clamps an electric wire that has been supplied in a predetermined electric-wire supplying direction, and an electric-wire nozzle unit which is placed on the downstream side of the clamping device in the electric-wire supplying direction and through which an electric wire is inserted, is designed so that a nozzle opening which is formed in the electric-wire nozzle unit and through which the electric wire is inserted is adjustably opened and closed, with a device that adjusts the size of the nozzle opening in response to the size of the outer diameter of the electric wire being installed therein.

In accordance with this aspect, even when the electric-wire diameter of an electric wire to be used is changed, the size of the nozzle opening in the electric-wire nozzle unit is automatically adjusted to a size corresponding to the electric-wire diameter by the above-mentioned device so that it becomes possible to eliminate the conventional exchanging operation of parts such as nozzles and consequently to shorten the operation time for the step-exchanging process.

In another aspect of the present invention, the electric-wire processing machine, which has an electric-wire-diameter measuring unit for measuring the outer diameter of an electric wire to be supplied along a predetermined electric-wire supplying direction, a clamping device that is placed on the downstream side of the electric-wire-diameter measuring unit in the electric wire supplying direction and releasably clamps an electric wire, and an electric-wire nozzle unit which is placed on the downstream side of the clamping device in the electric-wire supplying direction and through which an electric wire is inserted, is designed so that a nozzle opening which is formed in the electric-wire nozzle unit and through which the electric wire is inserted is adjustably opened and closed, with an interlocking device that adjusts the size of the nozzle opening in response to the size of the outer diameter of the electric wire measured by the electric-wire-diameter measuring unit being installed therein.

In accordance with this aspect, even when the electric-wire diameter of an electric wire to be used is changed, the size of the nozzle opening in the electric-wire nozzle unit is automatically adjusted to a size corresponding to the electric-wire diameter by the above-mentioned interlocking device so that it becomes possible to eliminate the conventional exchanging operation of parts such as nozzles and consequently to shorten the operation time for the step-exchanging process.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
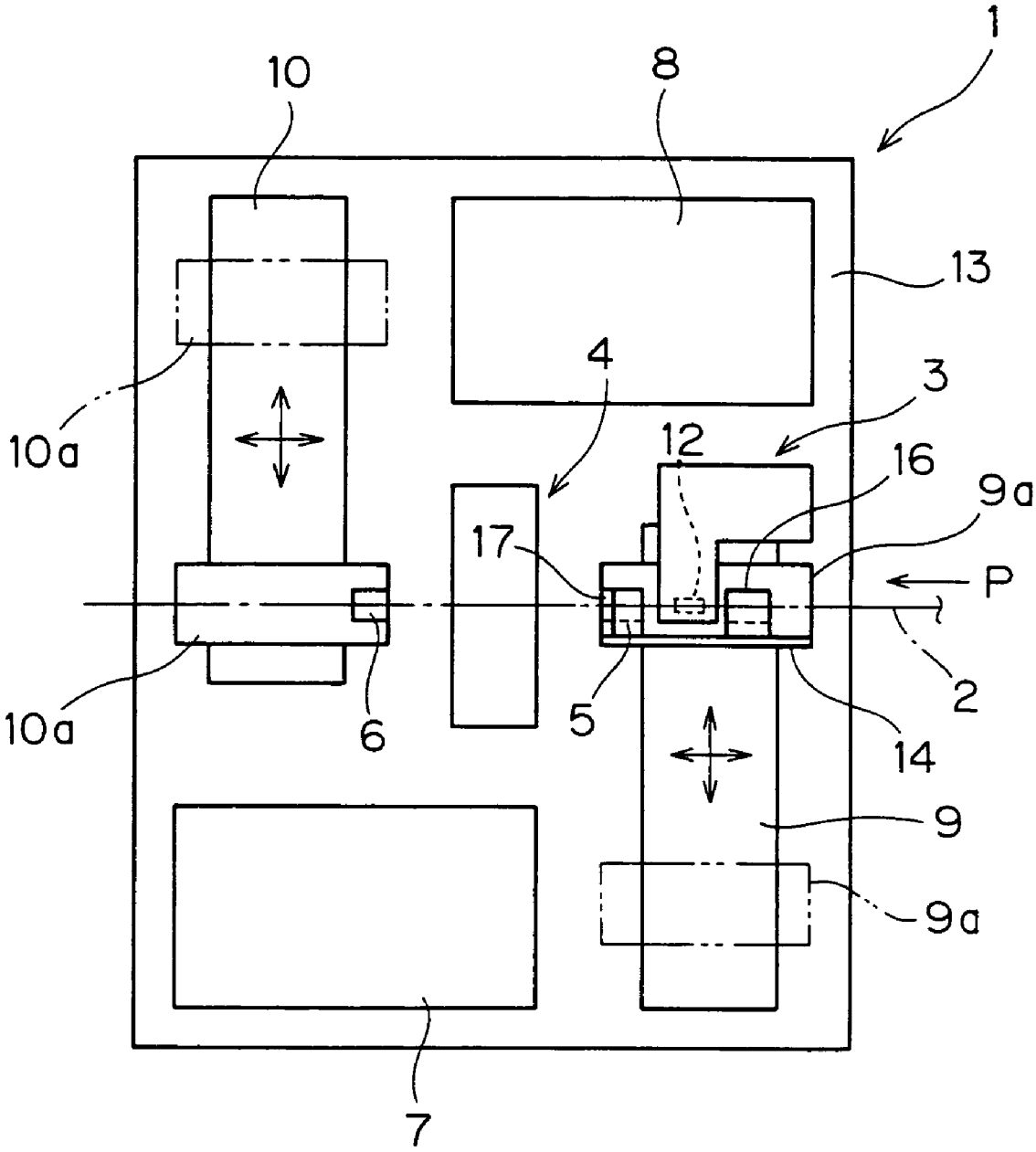
FIG. 1 is a schematic explanatory plan view that shows a first embodiment of the present invention.

Referring to the drawings, the following description will discuss the first embodiment of the present invention. FIG. 1 shows a double end terminal crimping device 1 as one example of an electric-wire processing machine, and this double end terminal crimping device 1 is mainly constituted by a length-measuring unit 3 serving as an electric-wire feeding means that successively feeds out an electric wire 2 along a predetermined electric-wire supplying direction P, and also measures the amount of feed, a cutter unit 4 for carrying out machining processes on the electric wire 2, a front-side clamping device 5 and a rear-side clamping device 6, a front-side terminal crimping unit 7 and a rear-side terminal crimping unit 8, and a front-side shifting means 9 and a rear-side shifting means 10.

The cutter unit 4 is designed so as to carry out a cutting process for cutting the electric wire 2 and a coat-removing process for removing a coated portion, and the front-side clamping device 5 and the rear-side clamping device 6 are allowed to releasably clamp the electric wire 2.

The length-measuring unit 3, which is provided with a pair of length-measuring rollers 12 that releasably hold the electric wire 2 therebetween with a predetermined pressure and also feeds out the electric wire 2 along the electric-wire supplying direction P through rotation in a predetermined direction, is attached and secured to a frame 13 of the double side terminal crimping device 1.

Moreover, the front-side clamping device 5, which is placed on a shifting base 9*a* of the front-side shifting means 9 through a supporting bracket 14 having an L-shape in its cross-section, is movably supported between the cutter-unit 4 position and the front-side terminal crimping unit 7 position by the shift of the shifting base 9*a*, and is also movably supported at the cutter-unit 4 position as well as at the front-side terminal crimping unit 7 position toward the cutter-unit 4 as well as toward the front-side terminal crimping unit 7. In other words, the front-side clamping device 5 is movably supported in the electric-wire supplying direction P as well as in a horizontal direction that is orthogonal to the electric-wire supplying direction P.

Moreover, as also shown in FIGS. 2 to 6, an electric-wire guide unit 16, which guides the electric wire 2 supplied along the electric-wire supplying direction P, is placed on the supporting bracket 14 attached to the shifting base 9*a* on the upstream side of the front-side clamping device 5 in the electric-wire supplying direction P, and an electric-wire nozzle unit 17 through which the electric wire 2 is guided and inserted is placed on one side face position is placed on the supporting bracket 14 attached to the shifting base 9*a* on the downstream side of the front-side clamping device 5 in the electric-wire supporting direction P.

A guide hole 18 through which the electric wire 2 is freely inserted and guided in the electric-wire supplying direction P is formed in the electric-wire guide unit 16, and a cutout step 19 that communicates with the outside is formed in the middle of the guide hole 18, a freely-rotatable fixed roller 20, which is fixedly placed on one side of the cutout step 19 so as to hold the electric wire 2 freely inserted along the guide hole 18 from both of the sides, and a freely-rotatable movable roller 21, which is supported movably toward and away from this fixed roller 20, are also installed in the electric-wire guide unit 16.

The movable roller 21 is secured to one end portion of a link arm 24 in a link mechanism 23. The link arm 24 is positioned between the electric-wire guide unit 16 and the electric-wire nozzle unit 17 and serves as an interlocking device supported by the supporting bracket 14 pivotably about a supporting shaft 22. A tension spring 25, which serves as a pressure spring, is passed over the one end portion of the link arm 24 and the supporting bracket 14. Here, the tension spring 25 has such a structure that the movable roller 21 is always elastically pressed in an approaching direction to the fixed roller 20 through the link arm 24.

Moreover, in a state in which the electric wire 2, which is supported in the electric-wire supporting direction P by the front-side clamping device 5 and the electric-wire guide unit 16, is positioned at the cutter-unit 4 position, the electric wire 2 between the front-side clamping device 5 and the electric-wire guide unit 16 is releasably held between the pair of the length-measuring rollers 12 that are controlled so as to mutually approach and depart to and from each other.

Figure 5:
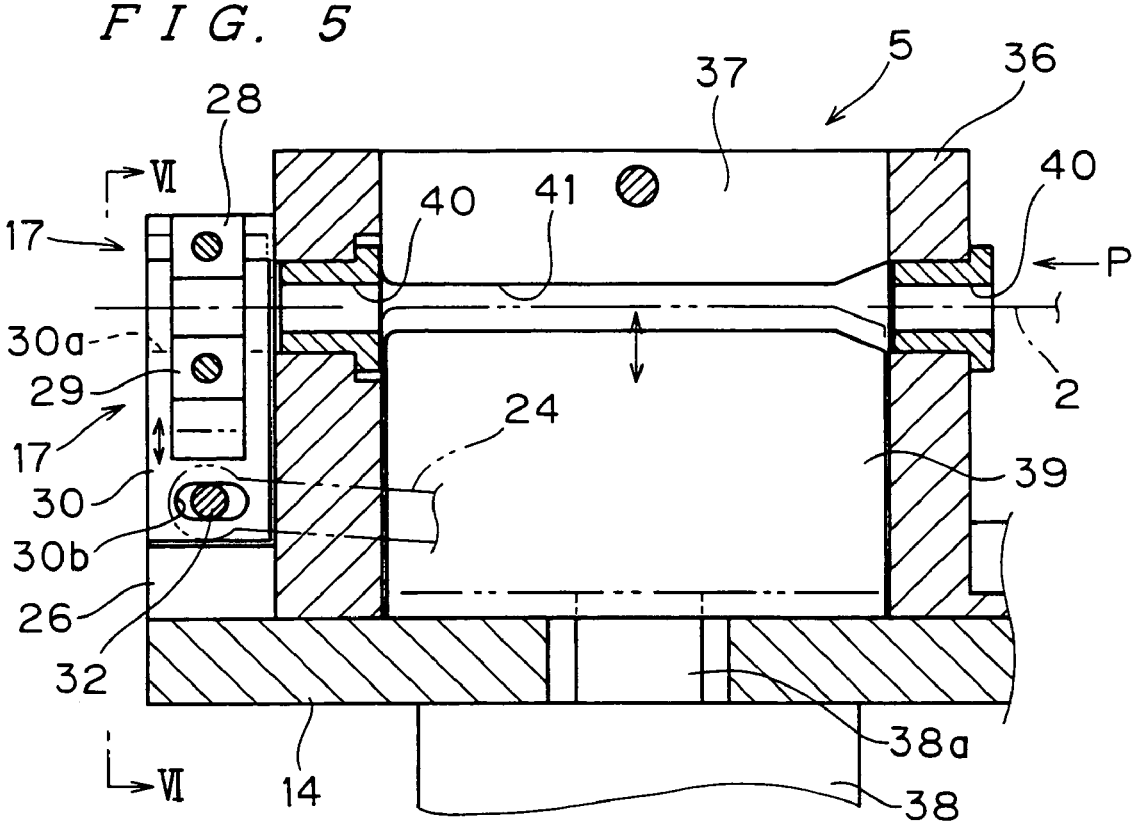
FIG. 5 is a partial enlarged cross-sectional view of FIG. 2.
Figure 6:
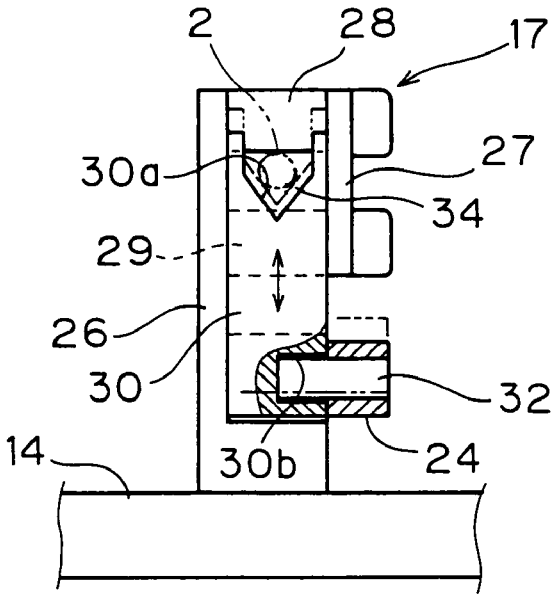
FIG. 6 is a cross-sectional view taken along line VI-VI of the electric-wire nozzle unit shown in FIG. 5.

As shown in FIG. 6, the electric-wire nozzle unit 17 is provided with a supporting guide 26 secured to the supporting bracket 14, with an L-shape in its side view, a pair of fixed nozzle guides 28 and 29 that are placed separately with a predetermined distance in between so as to be positioned on the respective sides of the electric wire 2 that is guided in the electric-wire supplying direction P, and secured to one side face of the supporting guide 26 through a guide plate 27, and a movable nozzle guide 30 that has a U-shape in its plan view, is allowed to freely slide along the two fixed nozzle guides 28 and 29 as shown in FIG. 5, and is also allowed to freely slide between the supporting guide 26 and the guide plate 27 as shown in FIG. 6.

Here, so-called V-shaped cutout sections 30*a*, which have a gradually-narrowed width, as shown in FIG. 6, are respectively formed in the two end portions of the movable nozzle guide 30 having a bifurcate.

Moreover, on the base side of the movable nozzle guide 30, an engaging groove 30*b* having an elongated shape is formed which fitting receives an interlocking shaft 32 protruding from the other end portion of the link arm 24 for slidable movement relative to the interlocking shaft 32.

Furthermore, in accordance with the size of the outer diameter of the electric wire 2 that is cooperatively held between the fixed roller 20 and the movable roller 21, when the movable roller 21 is operated so as to depart from or approach the fixed roller 20, the movable nozzle guide 30 is operated to slide through the link arm 24 so that, as shown in FIG. 6, a nozzle opening 34, which is cooperatively formed by one side face of the fixed nozzle guide 28 and the cutout section 30*a* of the movable nozzle guide 30, is size-adjusted. Thus, the fixed roller 20 and the movable roller 21 constitute an electric-wire-diameter measuring mechanism of the electric-wire-diameter measuring unit that measures the outer diameter of the electric wire 2 to be supplied in the electric-wire supplying direction P.

In this structure, in order to ensure a desired nozzle opening 34 in accordance with the diameter of an electric-wire that is allowed to pass between the fixed roller 20 and the movable roller 21, the position of the supporting shaft 22 that pivotably supports the link arm 24 is appropriately set.

Figure 2:
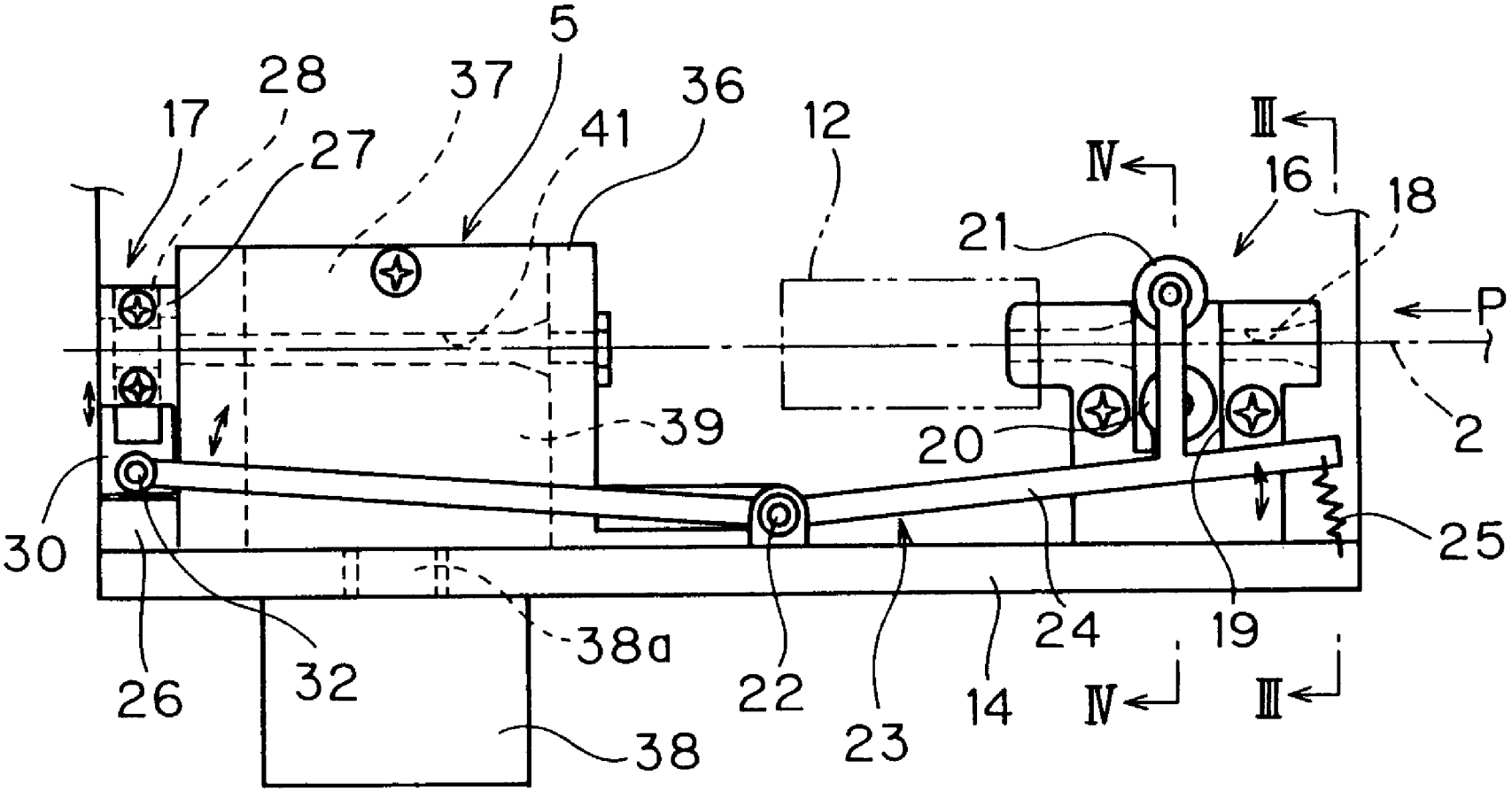
FIG. 2 is an enlarged view of an essential portion of FIG. 1.
Figure 3:
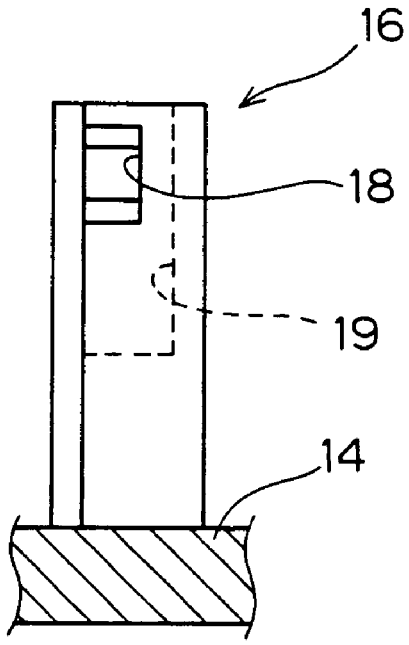
FIG. 3 is an enlarged view taken along line III-III of an electric-wire guide unit shown in FIG. 2.
Figure 4:
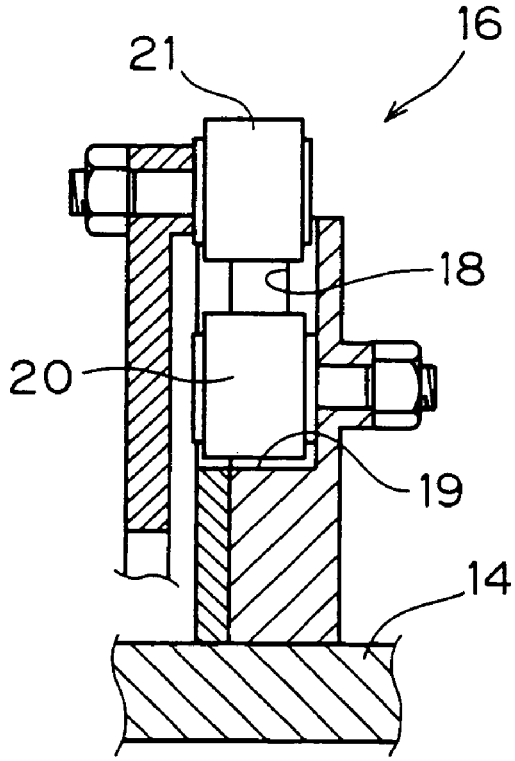
FIG. 4 is an enlarged cross-sectional view taken along line IV-IV of the electric-wire guide unit shown in FIG. 2.

Moreover, as shown in FIGS. 2 and 5, the front-side clamping device 5, which is provided with a claw-holding tube 36 secured to the supporting bracket 14, a fixed claw 37 that is secured and supported onto the inside of an idle end of the claw-holding tube 36, and a movable claw 39 that is placed inside the claw-holding tube 36, and secured to a piston rod 38*a* of an air cylinder 38 secured to the supporting bracket 14, is allowed to constitute a guide path 41 along the electric-wire supplying direction P by using the guide hole 40 formed in the claw-holding tube 36 and a mutual gap between the fixed claw 37 and the movable claw 39; thus, the electric wire 2, inserted through the guide path 41, is clamped by the fixed claw 37 and the movable claw 39 through protruding operations of a piston rod 38*a*, and is released from the clamped state through retreating operations of the piston rod 38*a*.

The rear-side clamping device 6, which is arranged virtually in the same manner as the front-side clamping device 5, is placed on the shifting base 10*a* of the rear-side shifting means 10, and movably supported between the cutter-unit 4 position and the rear-side terminal crimping unit 8 position through the shift of the shifting base 10*a*, and is also movably supported at the cutter-unit 4 position as well as at the rear-side terminal crimping unit 8 position toward the cutter unit 4 as well as toward the rear-side terminal crimping unit 8. In other words, the rear-side clamping device 6 is movably supported in the electric-wire supplying direction P as well as in a horizontal direction that is orthogonal to the electric-wire supplying direction P.

Thus, the electric wire 2, fed out by a predetermined length in the electric-wire supplying direction P by the length-measuring unit 3, is clamped by the front-side clamping device 5 and the rear-side clamping device 6, and cut by the cutter unit 4 in this state so that the electric wire 2 clamped by the front-side clamping device 5 and the electric wire 2 clamped by the rear-side clamping device 6 are separated from each other; thus, each of the end portions of the electric wires 2, clamped by the respective clamping devices 5 and 6, is then subjected to a coat-removing process in its coated portion by the cutter unit 4.

The electric wire 2, clamped by the front-side clamping device 5, is then shifted to the front-side terminal crimping unit 7 position so that a terminal is crimped onto the coat-removed portion by the front-side terminal crimping unit 7. After the crimping process of the terminal, the electric wire 2, clamped by the front-side clamping device 5, is returned to the initial position that faces the cutter unit 4. In this case, both of the length-measuring rollers 12 of the length-measuring unit 3 are maintained in a mutually separated open state. Both of the length-measuring rollers 12 are operated to approach each other after the arrival of the electric wire 2, and placed in a closed state in which the electric wire 2 is held therebetween.

Here, during the crimping process of a terminal onto the electric wire 2 on the front-side crimping device 5, the electric wire 2 on the rear-side crimping device 6 is also shifted to the rear-side terminal crimping unit 8 position so that a terminal is crimped onto the coat-removed portion by the rear-side terminal crimping unit 8, and the electric wire 2 is then discharged onto a predetermined electric-wire discharging section by a discharging unit, not shown, while the rear-side clamping device 6 is returned to the initial position that faces the cutter unit 4.

Then, in the same manner as described above, the electric wire 2 is fed out by a predetermined length along the electric-wire supplying direction P by the operation of the length-measuring unit 3, and through the same repeated processes, harnesses having a predetermined electric-wire length with terminals crimped on both of the end portions are successively manufactured.

The embodiment of the present invention is arranged as described above so that, when, upon exchanging steps, the electric-wire diameter is changed to a larger diameter, the mutual gap between the fixed roller 20 and the movable roller 21 is widened depending on the electric wire 2 guided to the electric-wire guiding unit 16, and in an interlocked manner with the departing shift of the movable roller 21, the link arm 24 is operated to pivot so that the movable nozzle guide 30 is operated to slide in the departing direction from the fixed nozzle guide 28 to adjust the nozzle opening 34 to have a greater opening through the pivoting operation of the link arm 24.

When the electric-wire diameter is changed to a smaller diameter, the mutual gap between the fixed roller 20 and the movable roller 21 is narrowed depending on the electric wire 2 guided to the electric-wire guiding unit 16, and in an interlocked manner with the approaching shift of the movable roller 21, the movable nozzle guide 30 is allowed to slide in the approaching direction toward the fixed nozzle guide 28 through the link arm 24 to adjust the nozzle opening 34 to have a smaller opening.

Therefore, even when the electric-wire diameter is changed, the size of the nozzle opening 34 in the electric-wire nozzle unit 17 is automatically adjusted to a size corresponding to the outer diameter of the electric wire 2; thus, different from the conventional device, it becomes possible to eliminate the necessity of exchanging parts such as nozzles, and consequently to eliminate the necessity of preparing and maintaining a plurality of kinds of nozzles, thereby making it possible to shorten operation time required for step exchanging.

Moreover, upon shifting the shifting base 9*a* of the front-side shifting means 9 between the cutter unit 4 and the front-side terminal crimping unit 7, since the electric wire 2 is held between the fixing roller 20 and the movable roller 21 on the upstream side in the electric-wire supplying direction P, while being clamped by the front-side clamping device 5 on the downstream side in the electric-wire supplying direction P, the electric wire 2 is maintained in an extended state between the front-side clamping device 5 and the electric-wire guiding unit 16 so that it is possible to effectively prevent length-measuring errors by the length-measuring roller 12 that measures the length of the electric wire maintained between the front-side clamping device 5 and the electric-wire guiding unit 16.

Moreover, the arrangement in which the electric-wire diameter is measured through the process of holding the electric wire 2 between the fixed roller 20 and the movable roller 21 and the size of the nozzle opening 34 of the electric-wire nozzle unit 17 is changed in accordance with the corresponding electric-wire diameter also provides a simple arrangement utilizing the link mechanism 23; therefore, this is easily achieved and prepared.

Moreover, since the cutout section 30*a* in the movable nozzle guide 30 is formed into a V-shape, the electric wire 2 to be guided and inserted through the nozzle opening 34 is maintained in a more stable state.

Here, the above-mentioned embodiment has a structure in which the front-side clamping device 5, the electric-wire guiding unit 16, the electric-wire nozzle unit 17 and the link mechanism 23 are respectively attached to the supporting bracket 14 having an L-shape in its cross section; however, a supporting bracket 14 having a flat-plate-shape may be used, and another structure in which the respective parts are attached to the shifting base 9*a* separately may be used.

Moreover, with respect to the size of the electric-wire diameter, the above-mentioned embodiment has a structure in which the size adjustments of the nozzle opening 34 of the electric-wire nozzle unit 17 are carried out through the link mechanism 23 by approaching and departing shifts of the movable roller 21 to and from the fixed roller 20; however, the electric-wire-diameter measuring unit that is shifted in approaching and departing manners is not intended to be limited by only these rollers 20 and 21, and a structure in which a flat-plate member or the like is pressed onto the electric wire 2, or a structure, which has an interlocking device that electrically reads the electric-wire diameter of the traveling electric wire 2 by using the electric-wire diameter measuring unit and operates the movable nozzle guide 30 of the electric wire nozzle unit 17 to slide by using a driving device, such as an air cylinder, so as to size-adjust the nozzle opening 34 in accordance with the size of the electric-wire diameter thus read, may be used; thus, the present invention is not intended to be limited by the link mechanism 23 of the present embodiment.

Figure 7:
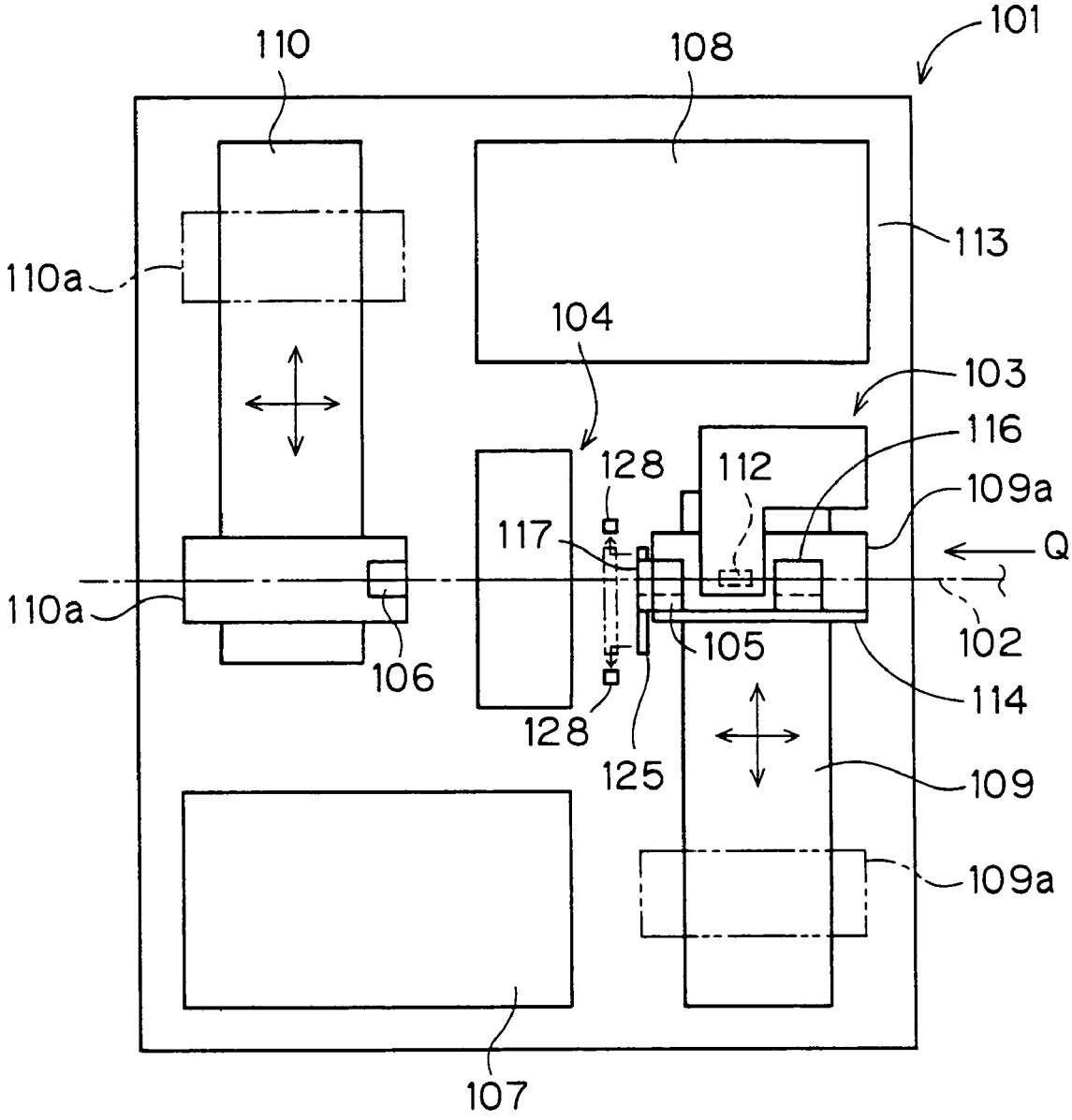
FIG. 7 is a schematic explanatory plan view that shows a second embodiment of the present invention.

FIGS. 7 to 11 show the second embodiment, and FIG. 7 shows a double end terminal crimping device 101 which is drive-controlled based upon numeric value data, and represents one example of the electric-wire processing machine, and the double end terminal crimping device 101 is mainly constituted by a length-measuring unit 103 that serves as an electric-wire feeding means that successively feeds the electric wire 102 in a predetermined electric-wire supplying direction Q and also measures the amount of feed, a cutter unit 104 for carrying out machining processes on the electric wire 102, a front-side clamping device 105 and a rear-side clamping device 106, a front-side terminal crimping unit 107 and a rear-side terminal crimping unit 108, and a front-side shifting means 109 and a rear-side shifting means 110.

The cutter unit 104 is designed to carry out a cutting process for cutting the electric wire 102 and a coat-removing process for removing a coated portion, and the front-side clamping device 105 and the rear-side clamping device 106 is allowed to releasably clamp the electric wire 102.

The length-measuring unit 103, which is provided with a pair of length-measuring rollers 112 that releasably hold the electric wire 102 therebetween with a predetermined pressure and also feeds out the electric wire 102 along the electric-wire supplying direction Q through rotation in a predetermined direction, is attached and secured to a frame 113 of the double side terminal crimping device 101.

Moreover, the front-side clamping device 105, which is placed on a shifting base 109*a* of the front-side shifting means 109 through a supporting bracket 114 having a desired shape, is movably supported between the cutter-unit 104 position and the front-side terminal crimping unit 107 position by the shift of the shifting base 109*a*, and is also movably supported at the cutter-unit 104 position as well as at the front-side terminal crimping unit 107 position toward the cutter-unit 104 as well as toward the front-side terminal crimping unit 107. In other words, the shifting base 109*a* is movably supported within a two-dimensional horizontal plane in the electric-wire supplying direction Q as well as in the horizontal direction orthogonal to the electric-wire supplying direction Q. For example, the shifting base 109*a* of the front-side shifting means 109 is designed to be drive-controlled through a servo-shaft that is driven and rotated by a servomotor, in such a manner as an XY table.

Figure 8:
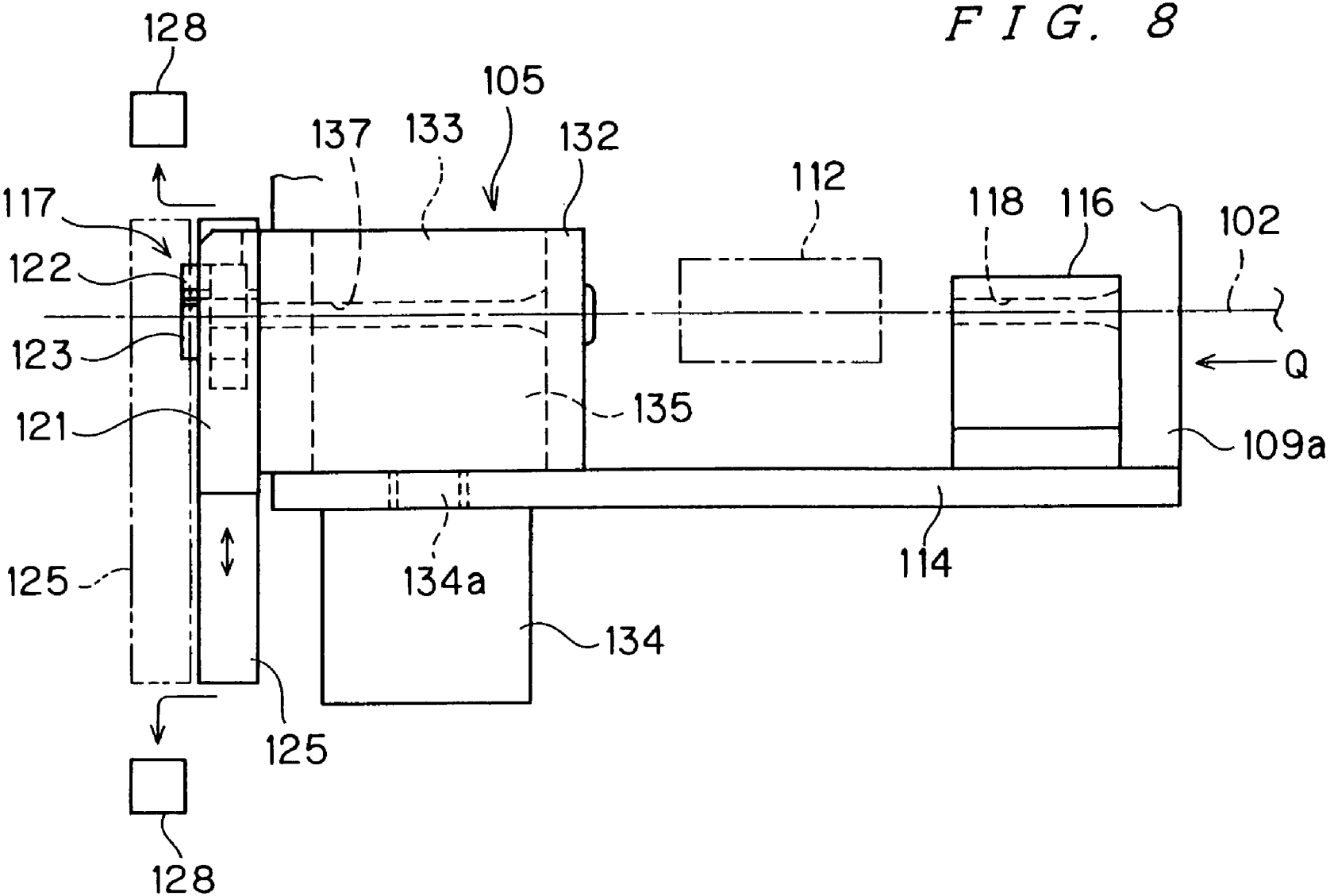
FIG. 8 is an enlarged view of an essential portion of FIG. 7.
Figure 9:
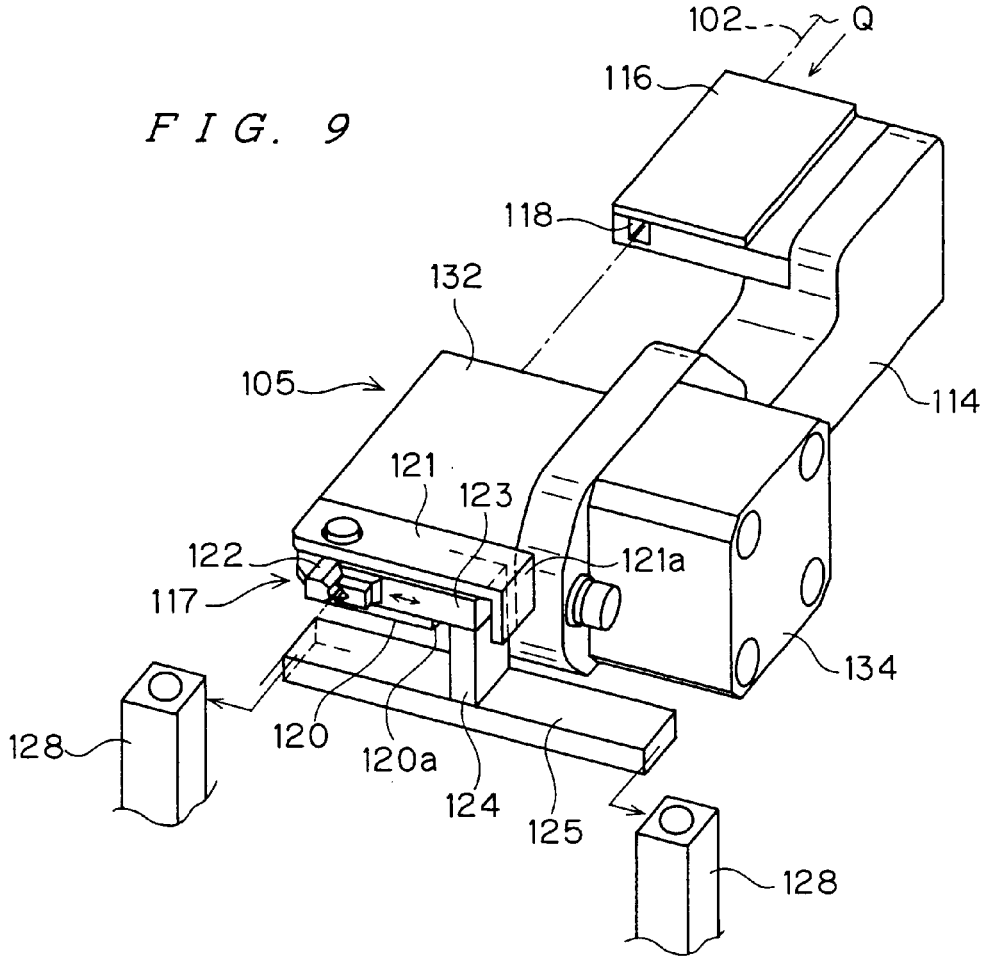
FIG. 9 is a perspective view of the essential portion of FIG. 7.

Furthermore, as also shown in FIGS. 8 and 9, an electric-wire guide unit 116, which guides the electric wire 102 supplied along the electric-wire supplying direction Q, is placed on the supporting bracket 114 attached to the shifting base 109*a* on the upstream side of the front-side clamping device 105 in the electric-wire supplying direction Q, and as also shown in FIGS. 8 to 11, an electric-wire nozzle unit 117 through which the electric wire 102 is guided and inserted is placed on one side face position is placed on the supporting bracket 114 attached to the shifting base 109*a* on the downstream side of the front-side clamping device 105 in the electric-wire supporting direction Q.

A guide hole 118 through which the electric wire 102 is freely inserted and guided in the electric-wire supplying direction Q is formed in the electric-wire guide unit 116.

Moreover, in a state in which the electric wire 102, which is supported in the electric-wire supporting direction Q by the front-side clamping device 105 and the electric-wire guide unit 116, is positioned at the cutter-unit 104 position, the electric wire 102 between the front-side clamping device 105 and the electric-wire guide unit 116 is releasably held between the pair of the length-measuring rollers 112 that are controlled so as to mutually approach and depart from each other.

Figure 10:
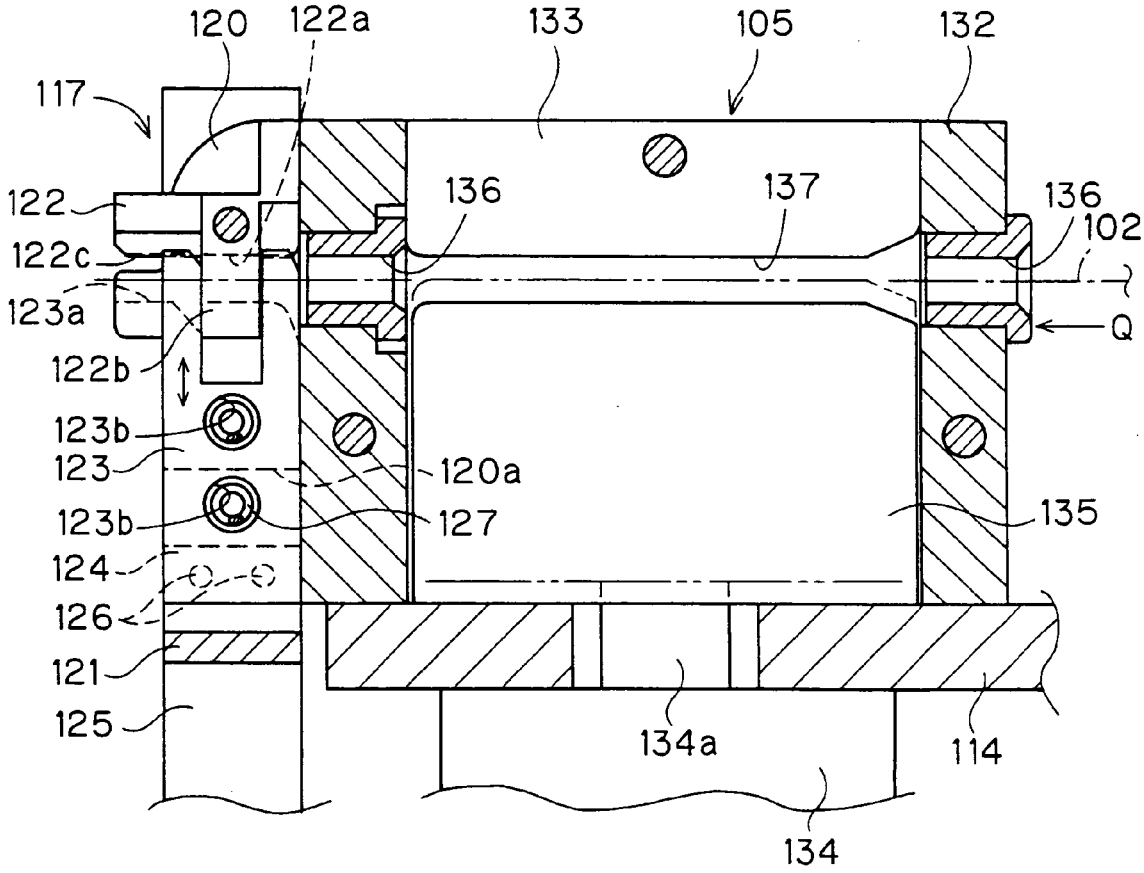
FIG. 10 is a partial enlarged cross-sectional view of FIG. 8.
Figure 11:
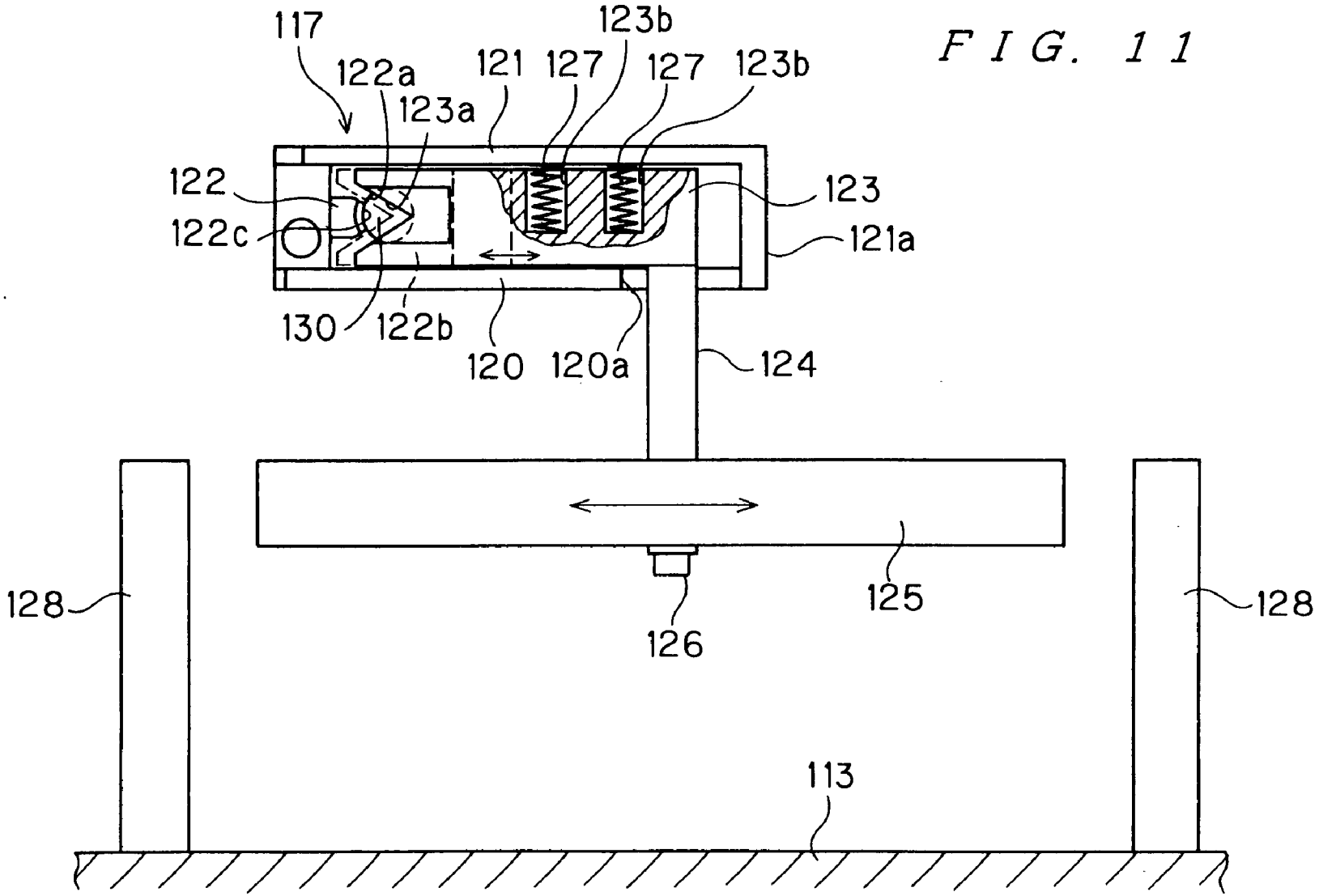
FIG. 11 is a partial enlarged left side view of FIG. 8.

As shown in FIGS. 8 to 11, the electric-wire nozzle unit 117, which has a flat-plate-shaped lower guide plate 120 and an upper guide plate 121 having an L-shape in a side-face view that are supported on a supporting bracket 114 in a horizontally fixed state, and a through hole 122*a* through which the electric wire 102, guided in the electric-wire supplying direction Q, is inserted, is further provided with a fixed nozzle guide 122 that is placed between the upper and lower guide plates 120 and 121, and secured by a fixing pin, a fixing screw and the like, and a movable nozzle guide 123 that is attached to one side portion, with a U-shape in its plan view as shown in FIG. 10, and is slidably placed along a slide guide portion 122*b* of the fixed nozzle guide 122, as well as between the upper and lower guide plates 120 and 121, as shown in FIG. 11.

Here, in the present embodiment, the movable nozzle guide 123 is allowed to freely slide in a horizontal direction orthogonal to the electric-wire supplying direction Q. A separation-regulating portion 121*a* suspended from an end of the upper guide plate 121 regulates the separation of the movable nozzle guide 123 from the gap between the two guide plates 120 and 121.

Moreover, so-called V-shaped cutout sections 123*a*, which have a gradually-narrowed width, as shown in FIG. 11, are respectively formed in the two end portions of the movable nozzle guide 123 having a bifurcate with a U-shape in its plan view.

Moreover, onto the lower face of the other side portion of the movable nozzle guide 123, an adjusting operation rod 125 having a predetermined length in the sliding direction of the movable nozzle guide 123 is attached and secured by using a bolt 126 or the like with a spacer 124 having a predetermined length located in between.

Here, a cutout portion 120*a* is formed in the lower guide plate 120 on demand in order to avoid interference from the spacer 124 when the movable nozzle guide 123 is allowed to slide, and in the upper face of the other side portion of the movable nozzle guide 123, a round spring holding hole 123*b* having a predetermined diameter, made by counter boring or the like, is formed, and a push spring 127, made of a coil spring or the like that is elastically pressed onto the lower face of the upper guide plate 121 through its pressing force on demand, is housed and held in the spring holding hole

123*b*, thereby forming a shift-regulating means that regulates an undesired sliding shift.

Moreover, as shown in FIGS. 7 to 9 and 11, a pair of stoppers 128, which are aligned face to face with each other with a distance that is desirably set longer than the adjusting operation rod 125 in a direction orthogonal to the electric-wire supplying direction Q are formed in a manner so as to stick out at positions that avoid shift trace lines of members, such as, the shifting base 109*a* that is positioned on the downstream side of the electric-wire nozzle unit 117 in the electric-wire supplying direction Q during machining processes of the electric wire 102 by the double end terminal crimping device 101, the supporting bracket 114 and the electric-wire nozzle unit 117. The present embodiment has a structure in which the rectangular-pillar-shaped stoppers 128 having a desired length are attached onto the frame 113 so as to stick out by using bolts or the like. In this case, the height of each of the stoppers 128 is made virtually the same height as the adjusting operation rod 125.

Further, in the initial state as shown in FIGS. 7 to 9, the shifting base 109*a* is operated to shift by a predetermined distance along the electric-wire supplying direction Q so as to place the adjusting operation rod 125 between the two stoppers 128, and this is then further operated to shift by a predetermined distance in either of directions orthogonal to the electric-wire supplying direction Q so that one end of the adjusting operation rod 125 is made in contact with the stopper 128, and is then further allowed to shift by a predetermined distance in this state in the corresponding direction; thus, the movable nozzle guide 123 is operated to slide in a relatively opposite direction so that the cutout portion 123*a* of the movable nozzle guide 123 and an arc-shaped electric-wire receiving portion 122*c* (see FIG. 11) of the fixed nozzle guide 122 in which an opposing portion of the through hole 122*a* facing this cutout portion 123*a* is formed into an extended shape in the electric-wire supplying direction Q are operated to approach or depart from each other; thus, a nozzle opening 130, which is cooperatively formed by the electric-wire receiving portion 122*c* of the fixed nozzle guide 122 and the cutout portion 123*a* of the movable nozzle guide 123, is size-adjusted.

Therefore, the adjusting operation rod 125, two stoppers 128 and the like, constitute an interlocking device that serves as a device for adjusting the size of the nozzle opening 130.

Moreover, when machining data in accordance with machining processes of the electric wire 102 is inputted, the opening-adjustment shifting operation of the shifting base 109*a*, which is carried out as described above, makes it possible to adjust the nozzle opening 130 through the interlocking device so that a desired nozzle opening 130 that corresponds to the electric wire diameter is obtained. Therefore, it becomes possible to effectively reduce pulsating movements of the electric wire 102 when the electric wire 102 is fed out in the electric-wire supplying direction Q through the nozzle opening 130, and consequently to stabilize feeding and receiving processes of the electric wire 102 to and from the rear-side clamping device 106 located on the downstream side.

Furthermore, as shown in FIGS. 8 to 10, the front-side clamping device 105, which is provided with a claw-holding case 132 having a tube shape secured to the supporting bracket 114, a fixed claw 133 that is secured and supported onto the inside of an idle end of the claw-holding case 132, and a movable claw 135 that is placed inside the claw-holding case 132, and secured to a piston rod 134*a* of an air cylinder 134 secured to the supporting bracket 114, is allowed to constitute a guide path 137 along the electric-wire supplying direction Q by using the guide hole 136 formed in the claw-holding case 132 and a mutual gap between the fixed claw 133 and the movable claw 135. Thus, the electric wire 102, inserted through the guide path 137, is clamped by the fixed claw 133 and the movable claw 135 through protruding operations of a piston rod 134*a*, and allowed to be released from the clamped state through retreating operations of the piston rod 134*a*.

The rear-side clamping device 106, which is arranged virtually in the same manner as the front-side clamping device 105, is placed on a shifting base 110*a* of the rear-side shifting means 110, and movably supported between the cutter-unit 104 position and the rear-side terminal crimping unit 108 position through the shift of the shifting base 110*a*, and is also movably supported at the cutter-unit 104 position as well as at the rear-side terminal crimping unit 108 position toward the cutter unit 104 as well as toward the rear-side terminal crimping unit 108. In other words, the rear-side clamping device 106 is movably supported in the electric-wire supplying direction Q as well as in a horizontal direction that is orthogonal to the electric-wire supplying direction Q. For example, the shifting base 110*a* of the rear-side shifting means 110 is designed to be drive-controlled through a servo-shaft that is driven and rotated by a servomotor, in such a manner as an XY table.

Upon carrying out machining processes of the electric wire 102, the electric wire 102, fed out by a predetermined length in the electric-wire supplying direction Q by the length-measuring unit 103, is clamped by the front-side clamping device 105 and the rear-side clamping device 106, and cut by the cutter unit 104 in this state so that the electric wire 102 clamped by the front-side clamping device 105 and the electric wire 102 clamped by the rear-side clamping device 106 are separated from each other; thus, each of the end portions of the electric wire 102, clamped by the respective clamping devices 105 and 106, is then subjected to a coat-removing process in its coated portion by the cutter unit 104.

The electric wire 102, clamped by the front-side clamping device 105, is then shifted to the front-side terminal crimping unit 107 position so that a terminal is crimped onto the coat-removed portion by the front-side terminal crimping unit 107. After the crimping process of the terminal, the electric wire 102, clamped by the front-side clamping device 105, is returned to the initial position that faces the cutter unit 104. In this case, both of the length-measuring rollers 112 of the length-measuring unit 103 are maintained in a mutually separated open state. Both of the length-measuring rollers 112 are operated to approach each other after the arrival of the electric wire 102, and placed in a closed state in which the electric wire 102 is held therebetween.

Here, during the crimping process of a terminal onto the electric wire 102 on the front-side crimping device 105 side, the electric wire 102 on the rear-side crimping device 106 side is also shifted to the rear-side terminal crimping unit 108 position so that a terminal is crimped onto the coat-removed portion by the rear-side terminal crimping unit 108, and the electric wire 102 is then discharged onto a predetermined electric-wire discharging section by a discharging unit, not shown, while the rear-side clamping device 106 is returned to the initial position that faces the cutter unit 104.

Then, in the same manner as described above, the electric wire 102 is fed out by a predetermined length along the electric-wire supplying direction Q by the operation of the length-measuring unit 103, and through the same repeated processes, harnesses having a predetermined length with terminals crimped on both of the ends are successively manufactured.

The embodiment of the present invention is arranged as described above so that, when, upon exchanging steps, the electric-wire diameter is changed to a larger diameter or a smaller diameter, machining data corresponding to the machining processes of the electric wire 102 is inputted, and in accordance with the machining program, based upon the electric wire diameter of the electric-wire information 102 of the machining data, the opening adjustment shift is first carried out by the shifting base 109*a* so that the shifting base 109*a* is operated to shift in the electric-wire supplying direction Q by a predetermined distance; thus, the adjusting operation rod 125 is positioned between the two stoppers 128.

Thereafter, this is then further operated to shift by a predetermined distance in either of directions orthogonal to the electric-wire supplying direction Q so that one end of the adjusting operation rod 125 is made in contact with the stopper 128 on the selected side, and is then further allowed to shift by a predetermined distance in the corresponding direction in this state; thus, the movable nozzle guide 123 is operated to slide in a relatively opposite direction so that the cutout portion 123*a* of the movable nozzle guide 123 and an arc-shaped electric-wire receiving portion 122*c* of the fixed nozzle guide 122 are operated to approach or depart from each other so that the nozzle opening 130 is adjusted to an appropriate size.

Here, the information of the electric-wire diameter that was used last time may be stored in a memory or the like, and the following shift-controlling operation may be carried out: in the case when, upon contact between the selected stopper 128 and the adjusting operation rod 125, the electric-wire diameter of this time is larger than the electric-wire diameter of last time, the contacting operation is adjusted to the direction that allows the nozzle opening 130 to become wider, while in the case when the electric-wire diameter of this time is smaller than the electric-wire diameter of last time, the contacting operation is adjusted to the direction that allows the nozzle opening 130 to become narrower.

Moreover, another shift-controlling operation may be used in which: after the adjusting operation rod 125 has been once made in contact with the stopper 128 in the opening direction of the nozzle opening 130 so as to be opened, the adjusting operation rod 125 is made in contact with the other stopper 128 so that the nozzle opening 130 is adjusted to an appropriate size.

After the adjustment of the nozzle opening 130, the shifting base 109*a* is returned to the initial position so that the above-mentioned machining processes are repeated.

Therefore, even when the electric-wire diameter of an electric wire 102 to be used is changed, the size of the nozzle opening 130 in the electric-wire nozzle unit 117 is automatically adjusted to a size corresponding to the electric-wire diameter of the electric wire 102 by the sliding operation of the movable nozzle guide 123 exerted by the opening adjustment shift of the shifting base 109*a*; thus, different from the conventional device, it becomes possible to eliminate the exchanging operation of parts such as nozzles, to also eliminate the necessity of preparing and maintaining a plurality of kinds of nozzles, and consequently to shorten the operation time for the step-exchanging process.

Moreover, since the present invention utilizes the shift of the shifting base 109*a* upon size-adjusting the nozzle opening 130 in the electric-wire nozzle unit 117, it becomes possible to compatibly utilize parts and also to simplify the structure of the interlocking device constituted by the adjusting operation rod 125, the stoppers 128 and the like for use in adjustments of the nozzle opening 130.

Furthermore, the size-adjustment of the nozzle opening 130 is carried out by slide-operating the movable nozzle guide 123 by using a simple structure in which the adjusting operation rod 125 is connected to the movable nozzle guide 123 of the electric-wire nozzle unit 117 with one end of the adjusting operation rod 125 being made in contact with one of the two stoppers 128 that are placed on the frame 113 so as to protrude therefrom; therefore, the device of the present invention can be easily achieved by a slight designing modification of the conventional double end terminal crimping device 101 at low cost.

Here, it is only necessary to connect the adjusting operation rod 125 to the movable nozzle guide 123 of the electric-wire nozzle unit 117 attached to the shifting base 109*a* so that it becomes possible to suppress an increase in the shift weight of the shifting base 109*a* as a whole, and also to suppress an increase in the shift load.

Further, since the stoppers 128 are placed at positions that avoid shift trace lines upon carrying out normal electric-wire 102 machining processes, these members do not cause any problem in shift-controlling the shifting base 109*a* upon carrying out machining processes on the electric wire 102, resulting in no problems in the machining processes of the electric wire 102.

Moreover, since the cutout portion 123*a* in the movable nozzle guide 123 is formed into a V-shape, the electric wire 102 to be guided and inserted into the nozzle opening 130 can be maintained in a stable state.

Furthermore, an undesired sliding shift of the movable nozzle guide 123 is effectively regulated by a pressing force of each of the push springs 127 housed in the spring holding holes 123*b*, thereby making it possible to effectively prevent shifts of the movable nozzle guide 123 due to vibration and the like at the time of shifting the shifting base 109*a*.

Here, the above-mentioned embodiment has exemplified a structure in which one end of the adjusting operation rod 125 is made in contact with the stopper 128 through the shifting operation in a direction orthogonal to the electric-wire supplying direction Q of the shifting base 109*a* so that the movable nozzle guide 123 is slide-operated; however, another structure in which the shifting base 109*a*, which is allowed to shift three-dimensionally, may be shift-controlled up and down directions so that the movable nozzle guide 123 is slide-controlled may be used, and the positions of the respective stoppers 128 are not intended to be limited by the positions described in the embodiment, and these may be placed any positions as long as they cause no problems in operations for normal machining processes.

Moreover, the present embodiment shows a control system in which based upon information of the electric wire 102 in inputted machining data, the nozzle opening 130 is adjusted; however, another control system in which the electric-wire diameter of the electric wire 102 is inputted through a data input means in a separate manner so that the nozzle opening 130 is adjusted based upon the data may be used.

Furthermore, with respect to the interlocking device that size-adjusts the nozzle opening 130, not limited by the structure of the above-mentioned embodiment, any size-adjusting device for the nozzle opening 130 may be used.

The above-mentioned embodiments have exemplified a case in which the double end terminal crimping device 1 or 101 is used as one example of the electric-wire processing machine; however, not limited by the above-mentioned embodiments, any other devices for processing the electric wire 2 or 102 may be used.

While the invention has been shown and described in detail, the foregoing description is in all aspects illustrative and not restrictive. It is therefore understood that numerous modifications and variations can be devised without departing from the scope of the invention.

What is claimed is:

1. An electric-wire processing machine comprising:

a clamping device that releasably clamps an electric wire that has been supplied in a predetermined electric-wire supplying direction; and an electric-wire nozzle unit which is placed on the downstream side of the clamping device in the electric-wire supplying direction and through which an electric wire is inserted, wherein a nozzle opening which is formed in the electric-wire nozzle unit and through which the electric wire is inserted is adjustably opened and closed, with a device that adjusts the size of the nozzle opening in response to the size of the outer diameter of the electric wire being installed therein, wherein the clamping device and the electric-wire nozzle unit are placed on a shifting base that is shift-controlled at least two-dimensionally, and an interlocking device, which allows the nozzle opening to be size-adjusted through opening-adjustment shifts of the shifting base in accordance with the diameter of the electric wire, is installed.

2. The electric-wire processing machine according to claim 1, wherein the electric-wire nozzle unit has a movable nozzle guide that open/close-adjusts the nozzle opening, and the movable nozzle guide is slide-operated by opening-adjustment shifts of the shifting base through the interlocking device so that the nozzle opening is size-adjusted.

3. The electric-wire processing machine according to claim 2, wherein the electric-wire nozzle unit has a fixed nozzle guide placed in a fixed state and the movable nozzle guide that is slidably placed and allowed to form the nozzle opening in cooperation with the fixed nozzle guide, the interlocking device has an adjusting operation rod that is connected to the movable nozzle guide, and a pair of stoppers which are placed face to face with each other at positions that avoid shift trace lines formed upon the electric-wire machining operations in the electric-wire processing machine, the two ends of the adjusting operation rod being selectively brought into and out of contacting relationship with the pair of stoppers, and the adjusting operation rod is shifted between the two stoppers through opening-adjustment shifts of the shifting base, with one end of the adjustment operation rod being made in contact with the selected one of the stoppers, so that the movable nozzle guide is slide-operated to size-adjust the nozzle opening.

4. An electric-wire processing machine comprising:

an electric-wire-diameter measuring unit for measuring the outer diameter of an electric wire to be supplied along a predetermined electric-wire supplying direction;

a clamping device that is placed on the downstream side of the electric-wire-diameter measuring unit in the electric wire supplying direction and releasably clamps an electric wire measured by the electric-wire-diameter measuring unit; and an electric-wire nozzle unit which is placed on the downstream side of the clamping device in the electric-wire supplying direction and through which the electric wire measured by the electric-wire-diameter measuring unit is inserted, wherein a nozzle opening which is formed in the electric-wire nozzle unit and through which the electric wire is inserted is adjustably opened and closed, and an interlocking device that adjusts the size of the nozzle opening in response to the size of the outer diameter of the electric wire measured by the electric-wire-diameter measuring unit is installed.

5. The electric-wire processing machine according to claim 4, wherein the electric-wire diameter measuring unit has an electric-wire diameter measuring mechanism, the electric-wire nozzle unit has a movable nozzle guide that open-close adjusts the nozzle opening, and the interlocking device has a link mechanism that couples the electric-wire diameter measuring mechanism and the movable nozzle guide so as to be interlocked with each other so that the movable nozzle guide is slide-operated through the link mechanism so as to size-adjust the nozzle opening, in accordance with the size of the electric wire.

6. The electric-wire processing machine according to claim 5, wherein the electric-wire diameter measuring mechanism has a fixed roller placed at a fixed position and a movable roller that is supported movably toward and away from the fixed roller, and the movable roller serves in cooperation with the fixed roller to hold an electric wire between the movable roller and the fixed roller, the electric-wire nozzle unit has a fixed nozzle guide that is placed in a fixed state and a movable nozzle guide that is slidably placed, and forms a nozzle opening in cooperation with the fixed nozzle guide, and the movable roller and the movable nozzle guide are connected to each other by the link mechanism so as to be interlocked with each other, with a tension spring, which presses the movable roller in an approaching direction toward the fixed roller, being attached so that in accordance with the size of the diameter of the electric wire to be held between the movable roller and the fixed roller, the movable nozzle guide is slide-operated through the link mechanism to size-adjust the nozzle opening.

* * * * *